US005630407A

United States Patent [19]

Gasser

[11] Patent Number: 5,630,407

[45] Date of Patent: May 20, 1997

[54] CONNECTING PIECE FOR THE STABILISER SYSTEM ON A BOW

[75] Inventor: Max Gasser, St. Margrethen, Switzerland

[73] Assignee: AGF Gasser AG, Switzerland

[21] Appl. No.: 230,555

[22] Filed: Apr. 20, 1994

[30] Foreign Application Priority Data

Apr. 27, 1993 [CH] Switzerland ..... 1279/93

[51] Int. Cl.[6] ..... F41B 5/20

[52] U.S. Cl. ..... 124/89; 403/170; 403/217

[58] Field of Search ..... 124/23.1, 24.1, 124/25.6, 86, 88, 89; 403/169, 170, 176, 217; 411/259, 263, 292, 955

[56] References Cited

U.S. PATENT DOCUMENTS

| | | | |
|---|---|---|---|
| 3,502,062 | 3/1970 | Shurts | 124/89 X |
| 3,752,142 | 8/1973 | Morita et al. | 124/89 |
| 3,804,072 | 4/1974 | Izuta | 124/89 |
| 4,054,121 | 10/1977 | Hoyt | 124/89 |
| 4,553,522 | 11/1985 | Topping | 124/89 |
| 5,239,977 | 8/1993 | Thomas | 124/89 |
| 5,320,085 | 6/1994 | Hanneman | 124/89 |

FOREIGN PATENT DOCUMENTS

| | | | |
|---|---|---|---|
| 74224 | 3/1983 | European Pat. Off. | 403/217 |
| 2317717 | 2/1977 | France | 403/217 |

*Primary Examiner*—John A. Ricci
*Attorney, Agent, or Firm*—Harold Gell

[57] ABSTRACT

A T-shaped connecting piece is provided to enable a front stabiliser and two counter-stabilisers to be fastened on the central bow part of a sports bow. The connecting piece may be screwed in the threaded hole provided in the central bow part for this purpose and may be clamped on the central bow part in the correct rotational position by means of a threaded tube. The counter-stabilisers are shifted further forward owing to the T-shape of the connecting piece, so they do not impair the archer. Owing to the clamped connection between the connecting piece and the central bow part, the transmission of the strong vibrations produced during the firing of an arrow from the sports bow to the stabilisers is optimally guaranteed so excellent shots may be fired.

14 Claims, 3 Drawing Sheets

FIG. 2A
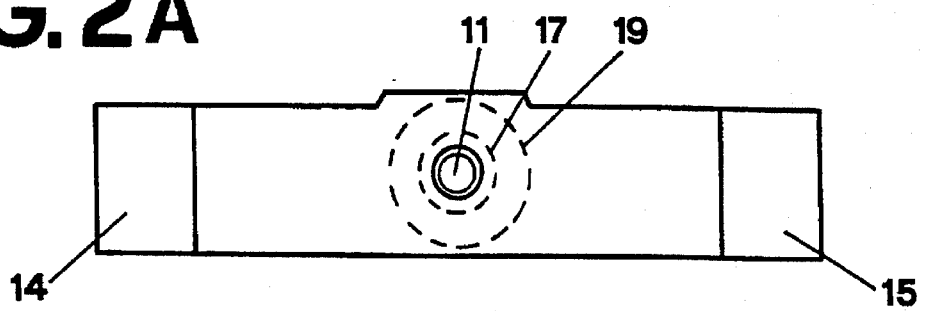
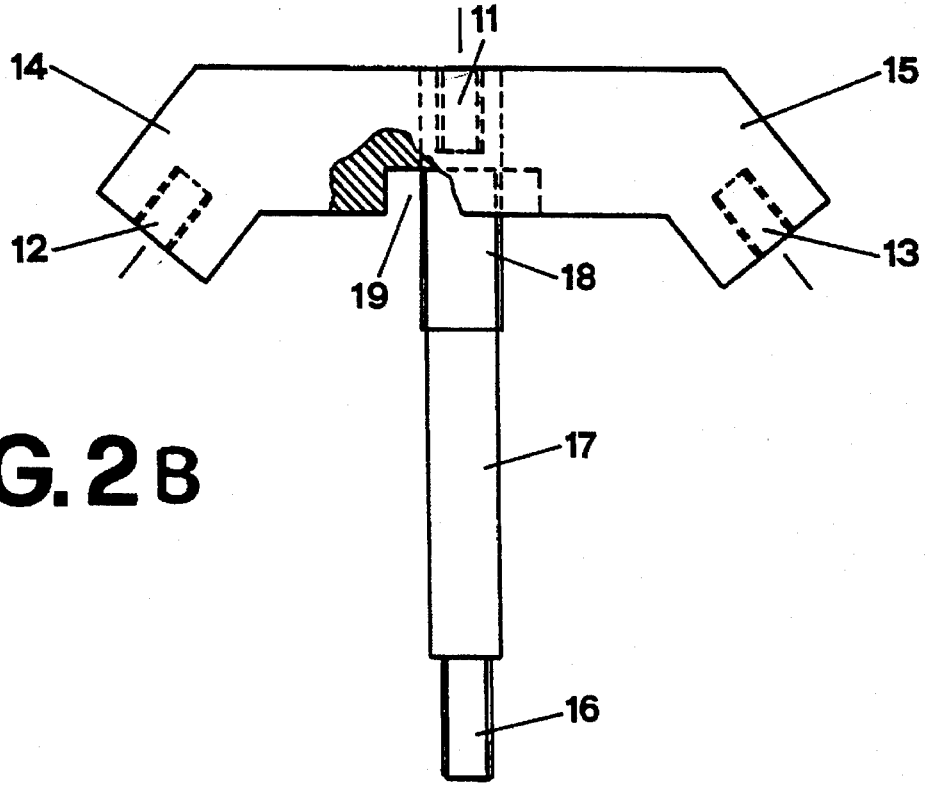
FIG. 2B
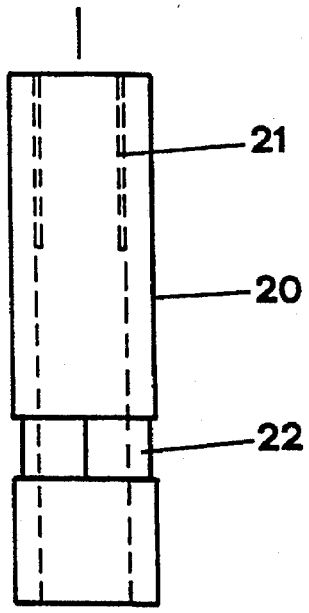
FIG. 2C

CONNECTING PIECE FOR THE STABILISER SYSTEM ON A BOW

FIELD OF THE INVENTION

The present invention relates to a connecting piece for the stabiliser system on a bow.

BACKGROUND OF THE INVENTION

When an arrow is released by a bow, considerable energy is transmitted from the bow to the arrow. The arrow therefore leaves the bow at a speed of up to 60–70 metres per second. This energy is produced by the tension of the bow which consists of a rigid central part and two flexible limbs arranged thereon as extensions thereof. The respective bow string is fastened in the region of the free ends of the two limbs. When the bow string is pulled, the limbs of the bow are bent and energy is therefore stored, the energy being released again by the relaxation of the limbs during the firing of the arrow. Vibrations of up to 50 Hz and higher are obviously produced during the relaxation of the limbs, or during the striking of the bow string, these vibrations being transmitted to the entire bow and therefore also to the arrow just leaving the bow. Logically, this impairs the accuracy of fire. In competitive shooting, even slight deviations from the optimum trajectory have significant consequences with respect to victory or defeat.

So-called stabilisers have been developed to overcome this problem. These are rod-shaped elements which are screwed at one end into the central part of the bow and have weights at their free ends. However, weights can also be arranged at the beginning and in the centre of the stabiliser. The stabilisers are designed such that they resiliently absorb the undesirable vibrations and stabilise the bow so the vibrations are transmitted to the arrow to the slightest possible extent. It has been found that one or even several stabilisers which are screwed in the direction of fire, i.e. on the side of the bow remote from the bow string, do not have the desired effect. The effect may be improved if backwardly directed counter-stabilisers or compensators are provided in addition to one or more so-called front stabilisers. Connecting pieces which may be screwed into the threaded hole provided for the front stabilisers on the front of the bow have been developed for fastening these counter-stabilisers. These connecting pieces in turn have a threaded hole in their axial extension on which the front stabiliser may be screwed. Threaded holes which are directed obliquely backwardly are additionally provided on the connecting piece for the fastening of two counter-stabilisers. It is also possible to provide points of attachment for two additional front stabilisers apart from those for the two counter-stabilisers. The term "spider" has been adopted as a name for the connecting pieces. Moreover, the English name "V-bar" is also known. However, as it is considered undesirable for various reasons if the two backwardly directed counter-stabilisers are placed close to the central part of the bow, attempts have been made to arrange an additional tubular extension piece between the connecting piece and the central part. However, this produces an additional, detrimental threaded joint.

It has been found that the development of the best stabilising effect by the front and counter-stabilisers depends quite decisively on the optimum fastening thereof on the central part of the bow. The accurate alignment, i.e. rotational position, of the screwed-in connecting piece as well as the rigid, i.e. clearance-free transition from the central part of the bow via the connecting piece or pieces to the stabilisers are important factors. Particular requirements are therefore placed on this transition region from a physical point of view.

SUMMARY OF THE INVENTION

The object of the present invention is to provide a connecting piece for the stabiliser system on a bow which guarantees optimum fastening and transmission of the vibrations from the bow to the stabilisers.

According to the present invention, there is provided a connecting piece for the stabiliser system on a sports bow, which connecting piece is substantially T-shaped with a central leg and a crossbar, wherein a threaded part is provided at the free end of the central leg to enable the connecting piece to be screwed in a corresponding threaded hole in the sports bow and wherein at least one stabiliser may be attached in the region of each free end of the crossbar.

BRIEF DESCRIPTION OF THE DRAWINGS

An embodiment of the subject of the invention is described in detail hereinafter with reference to the drawings.

FIGS. 2A, 2B and 2C show the construction of a connecting piece according to the invention.

DESCRIPTION OF PREFERRED EMBODIMENT

Figure 1:
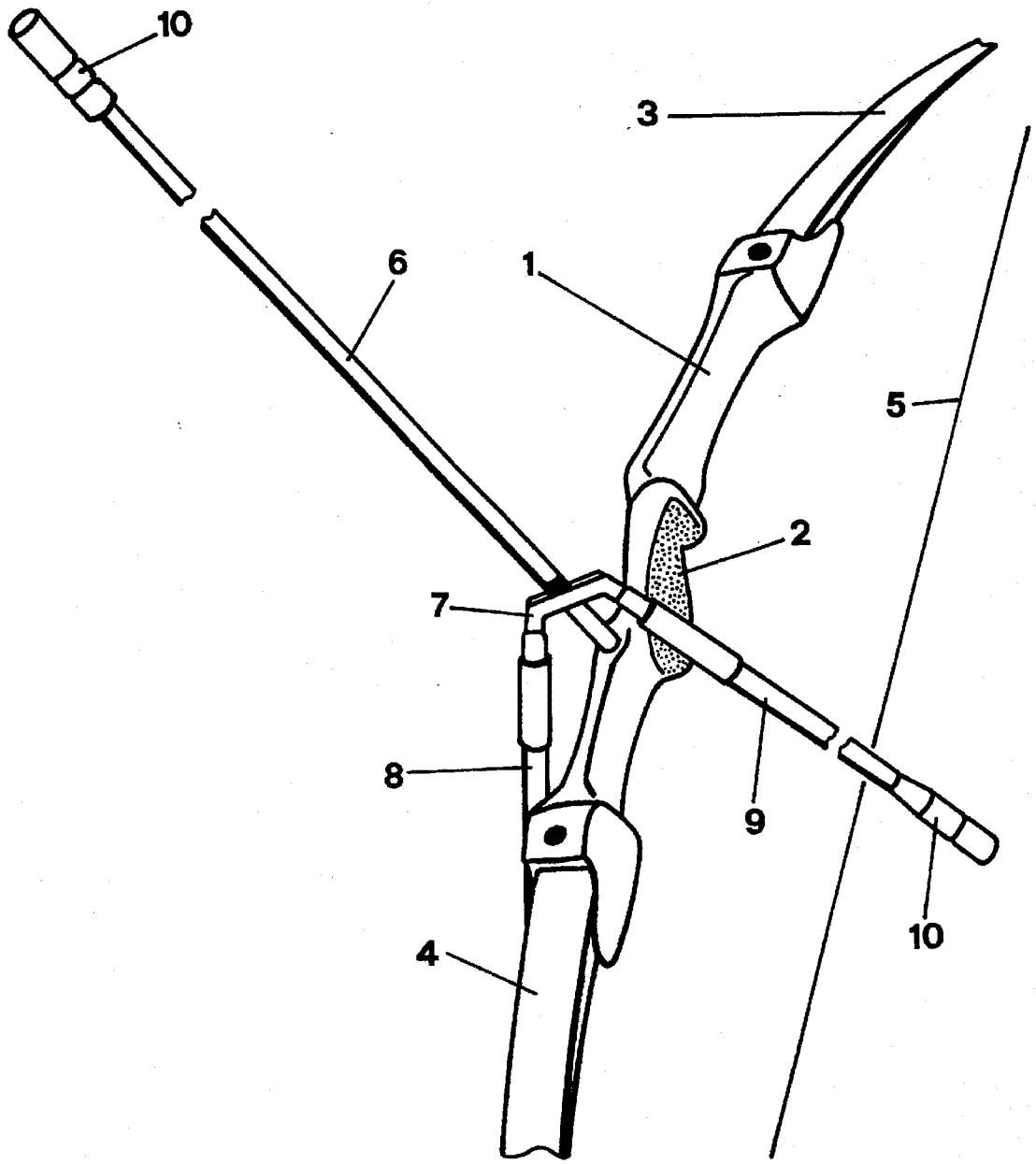
FIG. 1 is a view of the central part of the bow with a front stabiliser and two counter-stabilisers.

The parts of a bow which are essential to the invention are shown in FIG. 1. The bow has a central bow part 1 on which there is a grip surface 2 by means of which the bow is held. An upper limb 3 and lower limb 4 are fastened on or extend from the central part 1 of the bow. A bow string 5 is connected to the distal ends of the limbs 3 and 4. A threaded hole on which a front stabiliser 6 may be screwed is provided on the front side, i.e. the side of the bow directed toward the target, in the region of the grip surface 2. In the present case there is arranged, via a connecting piece 7, a stabiliser system having, in addition to the above-mentioned front stabiliser 6, two obliquely backwardly directed counter-stabilisers 8 and 9 each guided past one side of the central bow part 1. Weights 10 are arranged at the free ends of the rod-shaped stabilisers 6, 8 and 9 respectively.

It can easily be understood from this illustration that the T-shape of the connecting piece 7 according to the invention affords particular advantages. The counter-stabilisers 8 and 9 are thus shifted somewhat further forward and somewhat to the side in each case. They are therefore guided or shifted away from the region of the central bow part 1 or the grip surface 2 where they may obstruct the archer. Formerly known connecting pieces do not afford this advantage. The former connecting pieces are not T-shaped in design. They are smaller and only have the purpose of allowing three or more stabilisers to be screwed on the single threaded hole usually provided.

The technical details of the T-shaped connecting piece 7 emerge from FIG. 2. FIG. 2A shows the connecting piece 7 from the top with the threaded hole 11 for the fastening of the front stabiliser 6. FIG. 2B and 2C show a side view of the connecting piece 7 with threaded holes 12 and 13 at the free ends 14 and 15 of the shorter T-legs for screwing on two counter-stabilisers 8 and 9. The connecting piece 7 may be screwed on the central bow part 1 by means of a threaded part 16 at the free end of the longer central T-leg 17. The central T-leg 17 has a circular cross-section. The central T-leg 17 has a threaded part 18 in the region where it meets the two shorter T-legs, i.e. on the T-crossbar. The central T-leg 17 is stepped in design. It has the smallest diameter in the region of the first threaded part 16 owing to the threaded hole which is standardised in sports bows for the fastening of stabilisers. The second threaded part 18, on the other hand, is arranged on the region of the T-leg 17 having a greater diameter. The T-crossbar has a recess at the point where the central T-leg 17 is connected to the T-crossbar so that an annular groove 19 guided round the central T-leg 17 is formed here. A tube 20 may be screwed onto the central T-leg 17. Screwing is carried out by means of an internal thread 21 which is arranged at the end of the tube 20 to be screwed on and fits on the threaded part 18 of the central T-leg 17. The tube 20 is internally smooth elsewhere. The external diameter of the tube 20 and the annular groove 19 are dimensioned such that the tube 20 fits snugly into the annular groove 19. To simplify the screwing of the tube 20, the tube 20 is provided with a polygonal attachment 22 for a tool, i.e. for a spanner not shown here.

Figure 3:
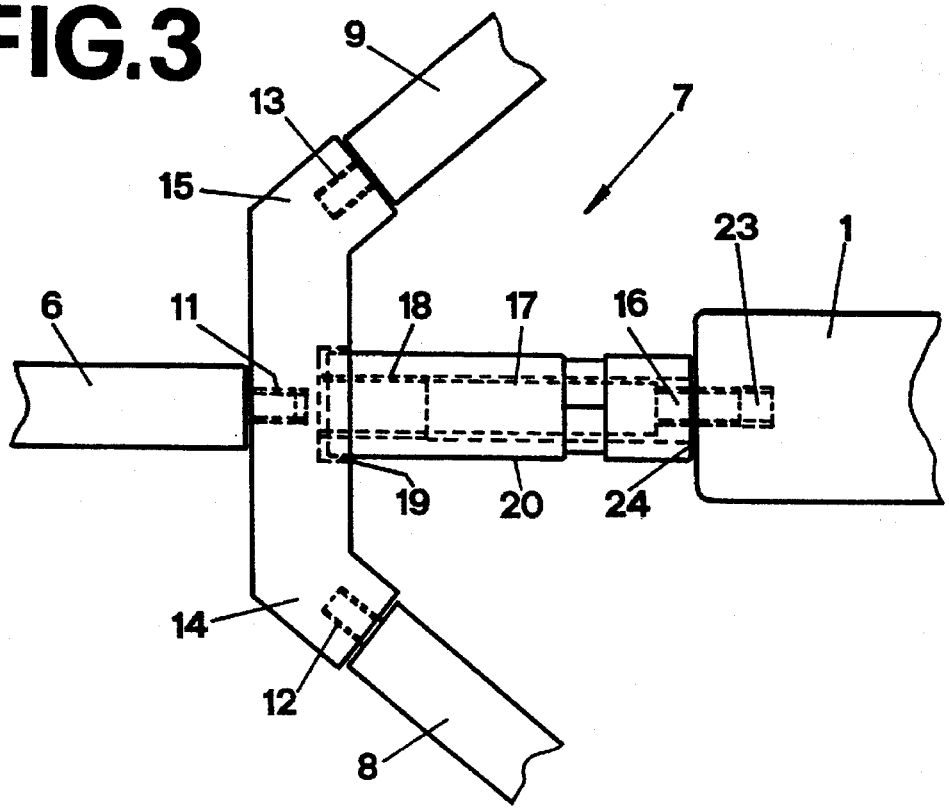
FIG. 3 shows a connecting piece according to FIG. 2 mounted on a central part of a bow.

The fastening of the connecting piece 7 to the central bow part 1 will now be described with reference to FIG. 3. The tube 20 is screwed as far as possible onto the threaded part 18 in the rest position before assembly so that it penetrates into the annular groove 19. The connecting piece 7 is now screwed by means of the threaded part 16 sufficiently far into the threaded hole 23 in the central bow part 1 for this end 24 of the tube 20 to rest on the central bow part 1. The connecting piece 7 should now be twisted out of the central bow part 1 somewhat and should thus be aligned such that the T-crossbar formed from the shorter T-legs 14 and 15 is exactly at right angles to the longitudinal axis of the central bow part 1. The connecting piece 7 can be locked in this position by rotation of the tube 20. For this purpose, the tube is twisted by means of a spanner until a clamped connection is produced between the end 24 of the tube 20 on the side of the central bow part and the central bow part 1. The connecting piece 7 is now fastened on the central bow part 1 in a secure, vibration-proof manner in exactly the correct rotational position. The stabilisers 6, 8 and 9 can then be screwed on the connecting piece.

In contrast to the formerly known connecting pieces which, like the stabilisers 6, 8 and 9 shown here, are screwed on the central bow part 1 merely by means of a thread, this design ensures that the connecting piece 7 rests non-rotatably in the optimum position and is additionally clamped on the central bow part 1 without any play. The transmission of the strong vibrations produced during the firing of an arrow from the sports bow to the stabilisers is therefore guaranteed in the best possible manner. The transmission of force is not impaired by play in the thread which impairs the action of the stabilisers. The optimum stabilising effect may therefore be achieved. The trajectory of the arrow is not impaired by technical shortcomings of the stabiliser system, so excellent shots may be fired.

Figure 4A:
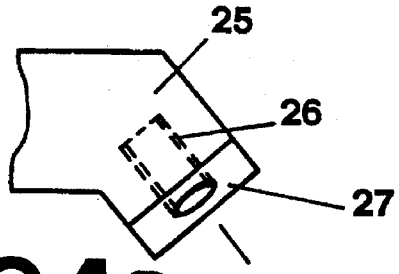
FIGS. 4A and 4B show a variation of the point of attachment for a counter-stabiliser.
Figure 4B:
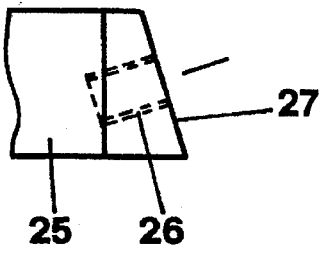

FIGS. 4A and 4B show a particular variation of the point of attachment for a counter-stabiliser. A threaded hole 26 for screwing on the stabiliser is also provided at the free end 25 of a shorter T-leg in this case. However, the free end 25 is obliquely offset, i.e. the external surface 27 is not at a right angle to the end 25 of T-leg. A decisive factor is that the threaded hole 26 deviates from the horizontal axis of the T-crossbar. As a result, the counter-stabiliser screwed on here is not only directed backwardly owing to the kink in the T-bar but also downwardly. A connecting piece of this design therefore ensures that the two counter-stabilisers each point obliquely backwardly and downwardly, away from the firing line. Therefore, they are less obstructive.

Figure 5:
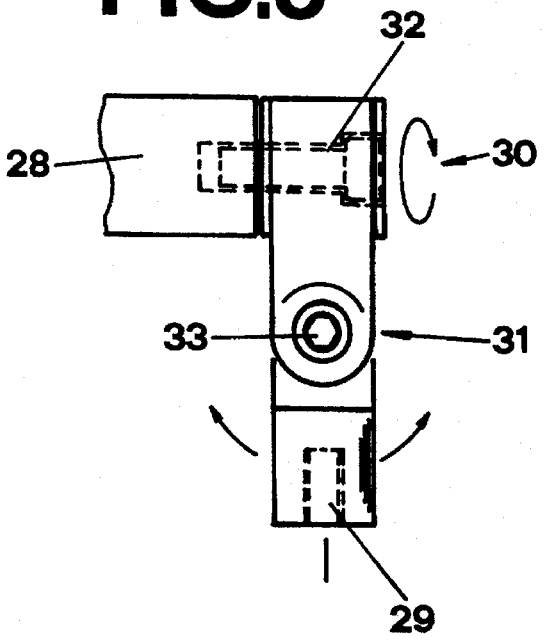
FIG. 5 shows a further variation of the point of attachment for a counter-stabiliser.

In a further development according to FIG. 5, the free end 28 of a shorter T-leg is provided with an adjusting device which allows the stabiliser screwed in a threaded hole 29 to be oriented as desired. Two articulations 30 and 31 which may each be fixed in their rotational position by a screw 32 or 33 are provided for this purpose.

I claim:

1. Connecting piece for the stabiliser system on a sports bow, which connecting piece is substantially T-shaped with a central leg and a crossbar wherein a threaded part is provided at the free end of the central leg to enable the connecting piece to be screwed in a corresponding threaded hole in the sports bow and wherein one stabiliser may be fastened to one end of said crossbar and wherein the central leg is provided at its other end with a second threaded part which is engageable in a screw-threaded bore in the crossbar, a tube with an internal screw-thread being mounted on the central leg and engageable with said second threaded part whereby the rotational position of the crossbar relative to the sports bow may be adjusted and the crossbar can be clamped in position by engaging the tube with said bow.

2. Connecting piece according to claim 1, in which at each free end of the crossbar, there is arranged a threaded hole extending obliquely backwardly at an angle of less than 90° from the central leg, in which a said stabiliser may be screwed.

3. Connecting piece according to claim 2, in which said threaded holes arranged at the free ends of the T-crossbar are arranged such that stabilisers to be mounted thereon are oriented obliquely backwardly and also obliquely downwardly.

4. Connecting piece according to claim 2, in which each free end of the crossbar intended for the mounting of stabilisers has at least one articulation so that the stabiliser to be arranged thereon may be orientated in a desired position.

5. Connecting piece according to claim 1, in which on the side of the crossbar remote from the central leg, there is arranged at least one point of attachment in the form of a threaded hole, to which a front stabiliser may be attached.

6. Connecting piece according to claim 1, in which a recess is provided in the crossbar at the point where the central leg is connected to the crossbar so as to form an annular groove guided round the central leg, the annular groove being dimensioned such that it can receive this end of the tube.

7. Connecting piece according to claim 6, in which the length of the tube is dimensioned in relation to the length of the central leg such that it can simultaneously rest non-positively with one end on the sports bow when the connecting piece is mounted on the sports bow while its other end is received in the annular groove.

8. Connecting piece for the stabiliser system on a sports bow, which connecting piece is substantially T-shaped with a central leg and a crossbar wherein a threaded part is provided at the free end of the central leg to enable the connecting piece to be screwed in a corresponding threaded hole in the sports bow and wherein a respective stabiliser may be fastened through each end of said crossbar and wherein the central leg is provided at its other end with a second threaded part which is engageable in a screw-threaded bore in the crossbar, a tube with an internal screw-thread being mounted on the central leg and engageable with said second threaded part whereby the rotational position of the crossbar relative to the sports bow may be adjusted and the crossbar can be clamped in position by engaging the tube with said bow.

9. Connecting piece according to claim 8, in which at each free end of the crossbar, there is arranged a threaded hole extending obliquely backwardly at an angle of less than 90° from the central leg, in which a said stabiliser may be screwed.

10. Connecting piece according to claim 9, in which the threaded holes arranged at the free ends of the T-crossbar are arranged such that the stabiliser to be mounted thereon is oriented obliquely backwardly and also obliquely downwardly.

11. Connecting piece according to claim 9, in which each free end of the crossbar intended for the mounting of stabilisers has at least one articulation so that the stabiliser to be arranged thereon may be orientated in a desired position.

12. Connecting piece according to claim 8, in which on the side of the crossbar remote from the central leg, there is arranged at least one point of attachment in the form of a threaded hole, to which a front stabiliser may be attached.

13. Connecting piece according to claim 8, in which a recess is provided in the crossbar at the point where the central leg is connected to the crossbar so as to form an annular groove guided round the central leg, the annular groove being dimensioned such that it can receive this end of the tube.

14. Connecting piece according to claim 13, in which the length of the tube is dimensioned in relation to the length of the central leg such that it can simultaneously rest non-positively with one end on the sports bow when the connecting piece is mounted on the sports bow while its other end is received in the annular groove.

* * * * *